US007031645B2

(12) United States Patent
Mashtare et al.

(10) Patent No.: US 7,031,645 B2
(45) **Date of Patent: *Apr. 18, 2006**

(54) APPARATUS AND METHOD FOR NON-INTERACTIVE MAGNETIC BRUSH DEVELOPMENT

(75) Inventors: Dale R. Mashtare, Bloomfield, NY (US); Christopher Snelling, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 576 days.

This patent is subject to a terminal disclaimer.

(21) Appl. No.: 10/320,862

(22) Filed: Dec. 16, 2002

(65) Prior Publication Data

US 2004/0126146 A1 Jul. 1, 2004

(51) Int. Cl.
*G03G 15/08* (2006.01)

(52) U.S. Cl. ..... 399/266; 399/267
(58) Field of Classification Search ..... 399/266, 399/267, 265, 290
See application file for complete search history.

(56) References Cited

U.S. PATENT DOCUMENTS 5,742,884 A * 4/1998 Germain et al. ..... 399/266
6,088,562 A * 7/2000 Belkhir et al. ..... 399/266
6,775,504 B1 * 8/2004 Godlove et al. ..... 399/266

* cited by examiner

*Primary Examiner*—Arthur T. Grimley
*Assistant Examiner*—Crystal Wagner
(74) *Attorney, Agent, or Firm*—Lloyd F. Bean, II

(57) ABSTRACT

In a development system including a developer transport adapted for depositing developer material on an imaging surface having an electrostatic latent image thereon, comprising: a housing defining a chamber storing a supply of developer material comprising carrier and toner; a donor member, mounted partially in the chamber and spaced from the imaging surface, for transporting developer on an outer surface thereof to a region opposed from the imaging surface, the donor member having a magnetic assembly having a plurality of poles, a sleeve, enclosing the magnetic assembly, rotating about the magnetic assembly; a developer bed height of the developer material produce by the rotation of the magnetic assembly on the donor member to a predefined developer bed height within a development nip; and a grid, spaced and interposed between the donor member and the charge retentive surface, the grid having being dispose longitudinal with respect to the charge retentive surface and the donor member, the grid being spaced such that developer bed contacts the grid.

9 Claims, 5 Drawing Sheets

APPARATUS AND METHOD FOR NON-INTERACTIVE MAGNETIC BRUSH DEVELOPMENT

BACKGROUND AND SUMMARY OF THE PRESENT INVENTION

The invention relates generally to an electrophotographic printing machine and, more particularly, to a development system which includes a magnetic developer roll for transporting magnetic developer materials to a development zone; and a magnetic system for generating a magnetic field to reduce developer material bed height in the development zone.

Generally, an electrophotographic printing machine includes a photoconductive member which is charged to a substantially uniform potential to sensitize the surface thereof. The charged portion of the photoconductive member is exposed to an optical light pattern representing the document being produced. This records an electrostatic latent image on the photoconductive member corresponding to the informational areas contained within the document. After the electrostatic latent image is formed on the photoconductive member, the image is developed by bringing a developer material into proximal contact therewith. Typically, the developer material comprises toner particles adhering triboelectrically to carrier granules. The toner particles are attracted to the latent image from the carrier granules and form a powder image on the photoconductive member which is subsequently transferred to a copy sheet. Finally, the copy sheet is heated or otherwise processed to permanently affix the powder image thereto in the desired imagewise configuration.

In the prior art, both interactive and non-interactive development has been accomplished with magnetic brushes. In typical interactive embodiments, the magnetic brush is in the form of a rigid cylindrical sleeve which rotates around a fixed assembly of permanent magnets. In this type of development system, the cylindrical sleeve is usually made of an electrically conductive, non-ferrous material such as aluminum or stainless steel, with its outer surface textured to control developer adhesion. The rotation of the sleeve transports magnetically adhered developer through the development zone where there is direct contact between the developer brush and the imaged surface, and charged toner particles are stripped from the passing magnetic brush filaments by the electrostatic fields of the image.

These systems employ magnetically hard ferromagnetic material, for example U.S. Pat. No. 4,546,060 discloses an electrographic, two-component dry developer composition comprising charged toner particles and oppositely charged, magnetic carrier particles, which (a) comprise a magnetic material exhibiting "hard" magnetic properties, as characterized by a coercivity of at least 300 gauss and (b) exhibit an induced magnetic moment of at least 20 EMU/gm when in an applied field of 1000 gauss, is disclosed. Magnetically "hard" carrier materials include strontium ferrite and barium ferrite, for example. These carrier materials tend to be electrically insulative as employed in electrophotographic development subsystems. The developer is employed in combination with a magnetic applicator comprising a rotatable magnetic core and an outer, nonmagnetizable shell to develop electrostatic images.

Non-interactive development is most useful in color systems when a given color toner must be deposited on an electrostatic image without disturbing previously applied toner deposits of a different color or cross-contaminating the color toner supplies.

It has been observed in systems employing magnetically hard ferromagnetic material that the magnetic brush height formed by the developer mass in the magnetic fields on the sleeve surface in this type development system is periodic in thickness and statistically noisy as a result of complex carrier bead agglomeration and filament exchange mechanisms that occur during operation. As a result, substantial clearance must be provided in the development gap to avoid photoreceptor interactions through direct physical contact, so that the use of a closely spaced development electrode critical to high fidelity image development is precluded. The effective development electrode is essentially the development sleeve surface in the case of insulative development systems although for conductive magnetic brush systems the effective electrode spacing is significantly reduced.

It has also been found that in the fixed assembly of permanent magnets, the magnetic pole spacing thereof cannot be reduced to an arbitrarily small size because allowance for the thickness of the sleeve and a reasonable mechanical clearance between the sleeve and the rotating magnetic core sets a minimum working range for the magnetic multiple forces required to both hold and tumble the developer blanket on the sleeve. Since the internal pole geometry defining the spatial wavelength of the tumbling component also governs the magnitude of the holding forces for the developer blanket at any given range, there is only one degree of design freedom available to satisfy the opposing system requirements of short spatial wavelength and strong holding force. Reducing the developer blanket mass by supply starvation has been found to result in a sparse brush structure without substantially reducing the brush filament lengths or improving the uneven length distribution.

The above problems with controlling developer bed height are exacerbated when magnetically soft carrier material is employed such as disclosed in U.S. Pat. No. 6,143,456; U.S. Pat. No. 4,937,166; U.S. Pat. No. 4,233,387; U.S. Pat. No. 5,505,760; and U.S. Pat. No. 4,345,014 which are hereby incorporated by reference. U.S. Pat. No. 4,345,014 discloses a magnetic brush development apparatus which utilizes a two-component developer of the type described. The magnetic applicator is of the type in which the multiple pole magnetic core rotates to effect movement of the developer to a development zone. The magnetic carrier disclosed in this patent is of the conventional variety in that it comprises relatively "soft" magnetic material (e.g., magnetite, pure iron, ferrite or a form of $Fe_3O_4$) having a magnetic coercivity, HC, of about 100 gauss or less. Such soft magnetic materials have been preferred heretofore because they inherently exhibit a low magnetic remittance, $B_R$, (e.g., less than about 5 EMU/gm) and a high induced magnetic moment in the field applied by the brush core. It is desirable to use magnetically soft carrier material because having a low magnetic remittance, soft magnetic carrier particles retain only a small amount of the magnetic moment induced by a magnetic field after being removed from such field; thus, they easily intermix and replenish with toner particles after being used for development. Additionally, conductive carrier material options are significantly broadened for the "soft" magnetic carriers. Also having a relatively high magnetic moment when attracted by the brush core, such materials are readily transported by the rotating brush and are prevented from being picked up by the photoconductive member during development.

SUMMARY OF THE INVENTION

The present invention obviates the problems noted above by utilizing a development system including a developer transport adapted for depositing developer material on an imaging surface having an electrostatic latent image thereon, comprising: a housing defining a chamber storing a supply of developer material comprising carrier and toner; a donor member, mounted partially in said chamber and spaced from the imaging surface, for transporting developer on an outer surface thereof to a region opposed from the imaging surface, said donor member having a magnetic assembly having a plurality of poles, a sleeve, enclosing said magnetic assembly, rotating about said magnetic assembly; a developer bed height of said developer material produce by the rotation of said magnetic assembly on said donor member to a predefine developer bed height within a development nip; and a grid, spaced and interposed between said donor member and the charge retentive surface, said grid having being dispose longitudinal with respect to the charge retentive surface and said donor member, said grid being spaced such that developer bed contacts said grid.

DETAILED DESCRIPTION

Figure 1:
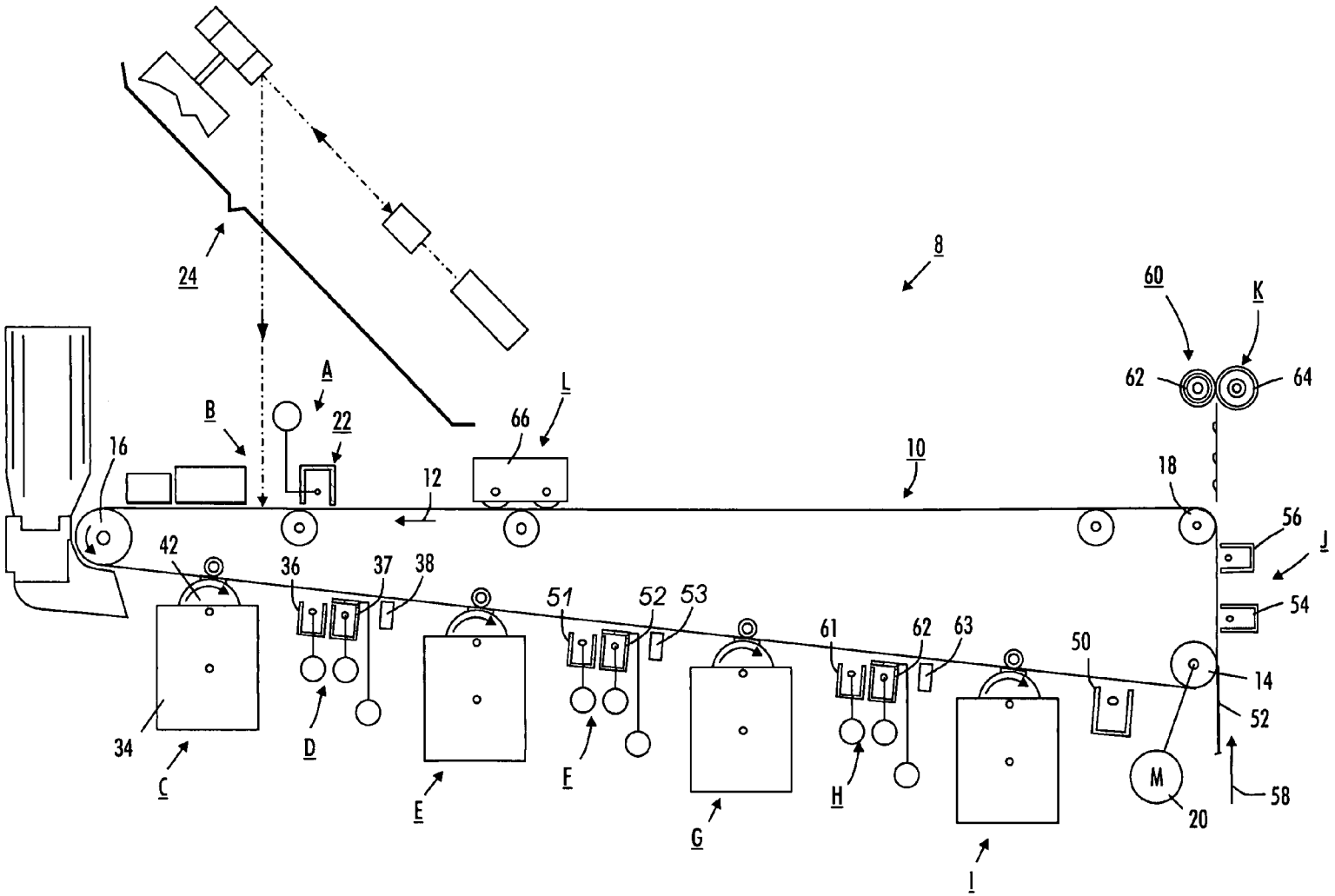
FIG. 1 is a schematic elevational view of an illustrative electrophotographic printing or imaging machine or apparatus incorporating a development apparatus having the features of the present invention therein.

For a general understanding of the present invention, reference Is made to the drawings. In the drawings, like reference numerals have been used throughout to designate identical elements. FIG. 1 shows a schematic elevational view of an electrophotographic printing machine incorporating the features of the present invention therein. It will become evident from the following discussion that the present invention is equally well suited for use in a wide variety of printing systems, and is not necessarily limited in its application to the particular system shown herein.

Now referring to FIG. 1, there is shown an illustrative electrophotographic machine having incorporated therein the development apparatus of the present invention. An electrophotographic printing machine 8 creates a color image in a single pass through the machine and incorporates the features of the present invention. The printing machine 8 uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

As the photoreceptor belt 10 moves, the image area passes through a charging station A. At charging station A, a corona generating device, indicated generally by the reference numeral 22, charges the image area to a relatively high and substantially uniform potential.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention.

After passing through the first exposure station B, the now exposed image area passes through a first development station C which is identical in structure with development system E, G, and I. The first development station C deposits a first color, say black, of negatively charged toner onto the image area. That toner is attracted to the less negative sections of the image area and repelled by the more negative sections. The result is a first toner powder image on the image area.

For the first development station C, development system 34 includes a donor roll 42. Donor roll 42 is mounted, at least partially, in the chamber of developer housing 44. The chamber in developer housing 44 stores a supply of developer (toner) material that develops the image. Toner (which generally represents any color of toner) adheres to the illuminated image area.

After passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B.

The image area then passes to a second development station E. Except for the fact that the second development station E contains a toner 40 which is of a different color (yellow) than the toner (black) in the first development station C, the second development station is beneficially the same as the first development station. Since the toner is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37. Briefly, the first corona recharge device 51 overcharges the image areas to a greater absolute potential than that ultimately desired (say −700 volts) and the second corona recharging device, comprised of coronodes having AC potentials, neutralizes that potential to that ultimately desired.

The now recharged image area then passes through a third exposure station 53. Except for the fact that the third exposure station illuminates the image area with a light representation of a third color image (say magenta) so as to create a third electrostatic latent image, the third exposure station 53 is the same as the first and second exposure stations B and 38. The third electrostatic latent image is then developed using a third color of toner (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 52 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 52. This causes the negatively charged toner powder images to move onto the support sheet 52. The transfer station J also includes a detack corona device 56 which facilitates the removal of the support sheet 52 from the printing machine 8.

After transfer, the support sheet 52 moves onto a conveyor (not shown) which advances that sheet to a fusing station K. The fusing station K includes a fuser assembly, indicated generally by thee reference numeral 60, which permanently affixes the transferred powder image to the support sheet 52. Preferably, the fuser assembly 60 includes a heated fuser roller 62 and a backup or pressure roller 64. When the support sheet 52 passes between the fuser roller 62 and the backup roller 64 the toner powder is permanently affixed to the sheet support 52. After fusing, a chute, not shown, guides the support sheets 52 to a catch tray, also not shown, for removal by an operator.

After the support sheet 52 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Figure 2:
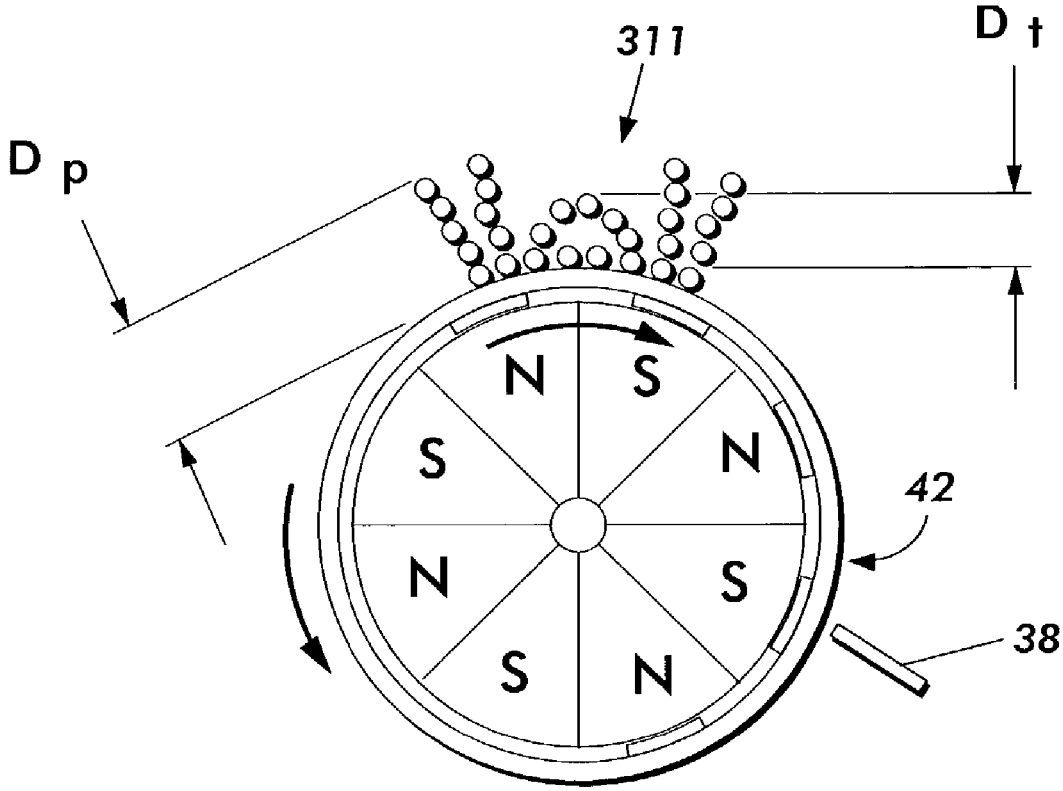
FIG. 2 is a schematic view showing the donor roll illustrates variations in the developer bed height of development apparatus used in the FIG. 3 printing machine.

Focusing on the development process, developer material is magnetically attracted toward the magnetic assembly of donor roller forming brush filaments corresponding to the magnetic field lines present above the surface of the sleeve. It has been observed that carrier beads tend to align themselves into chains that extend normal to the development roll surface over pole faces and lay down parallel to the roll surface between pole faces where the magnetic field direction is tangent to the roll surface. The net result is that the effective developer bed height varies from a maximum over pole face areas to a minimum over the pole transition areas. This effect is illustrated in FIG. 2. Rotation of the magnetic assembly causes the developer material, to collectively tumble and flow due to the response of the permanently magnetic carrier particles to the changes in magnetic field direction and magnitude caused by the internal rotating magnetic roll. This flow is in a direction "with" the photoreceptor belt 10 in the arrangement depicted in FIG. 4. Magnetic agitation of the carrier which serves to reduce adhesion of the toner particles to the carrier beads is provided by this rotating harmonic multiple magnetic roll within the development roll surface on which the developer material walks.

In the desired noninteractive development mode carrier beads must be prevented from touching the photoreceptor surface or any previously deposited toner layers on the photoreceptor. This is to prevent disturbance of the previously developed toner image patterns that are being combined on the photoreceptor surface to create composite color images. The variation in developer bed height illustrated in FIG. 2 forces the minimum spacing between the photoreceptor and the developer bed surface to be determined by the bed height at the pole areas where the bed height $D_p$ is largest in order to prevent interaction. The average spacing achieved in this manner is then determined by the average bed height which will be greater than the minimum bed height—i.e. $(D_p+D_t)/2>D_t$.

Figure 3:
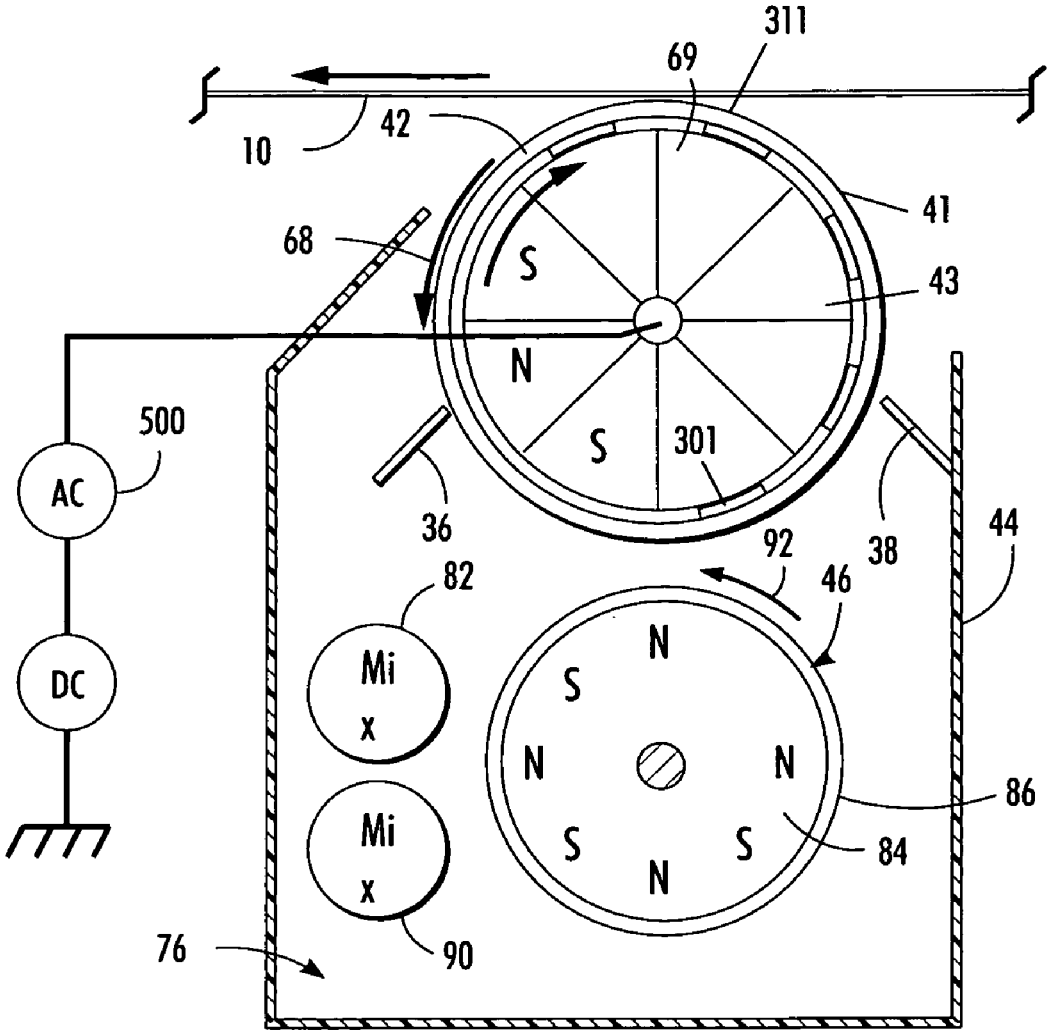
FIGS. 3 and 4 are a schematic view showing incorporating a development apparatus having the features of the present invention therein.

Referring now to FIG. 3 in greater detail, development system 34 includes a housing 44 defining a chamber 76 for storing a supply of developer material therein. Donor roll 42 comprises an interior rotatable harmonic multiple magnetic assembly 43 and an outer sleeve 41. The sleeve can be rotated in either the "with" or "against" direction relative to the direction of motion of the photoreceptor belt 10. Similarly, the magnetic assembly can be rotated in either the "with" or "against" direction relative to the direction of motion of the sleeve 41. Preferably, sleeve has a thickness about 100 to 350 microns and magnetic assembly has a pole spacing from 1 mm to 1 cm. The relative rotation is between 200 to 2000 rpm. It is preferred to adjust the parameters of pole spacing, sleeve thickness and relative rotation to achieve 6–10 flips of bead chains which is accomplished by sliding the bead chain from being over one type of magnetic pole (e.g., N) within the development sleeve to being over the opposite type of magnetic pole (e.g., S) in the development zone 311 to attain a sufficient toner supply to develop to field collapse.

Figure 4:
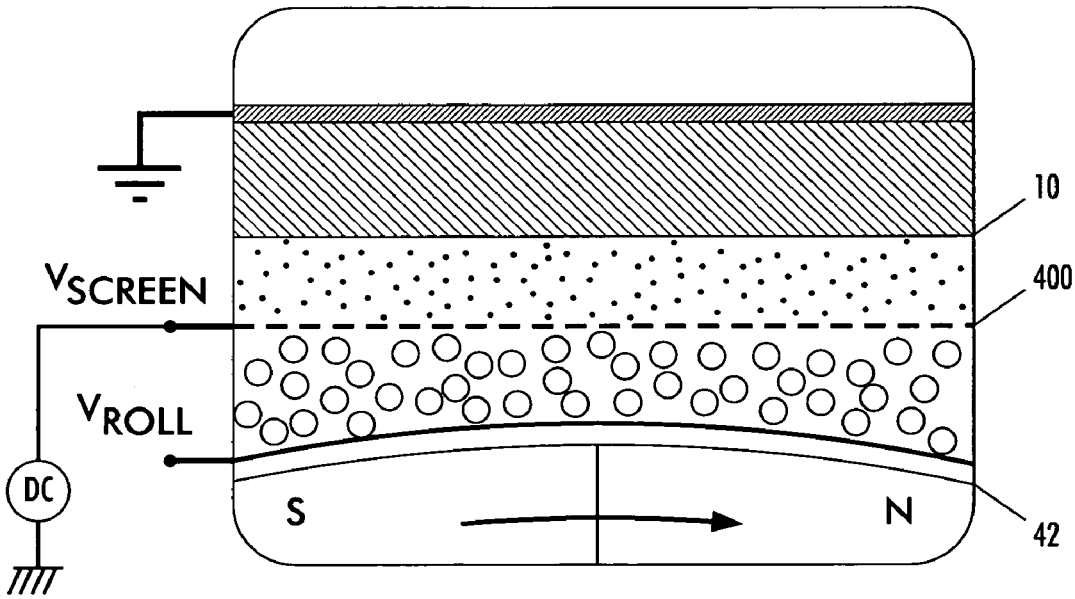

In FIG. 4, the sleeve is shown rotating in the direction of arrow 68 that is the "with" direction of the belt and magnetic assembly is rotated in the direction of arrow 69. Blade 38 is placed in near contact with the rotating donor roll 42 to trim the height of the developer bed. Blade 36 is placed in contact with the rotating donor roll 42 to continuously remove developer from the roll for return to the developer chamber 76.

A DC and AC bias is applied to sleeve 41 by power supply 500, which serves as the development electrode, to effect the necessary development bias with respect to the image potentials present on the photoreceptor.

Magnetic roller 46 advances a constant quantity of developer onto donor roll 42. This ensures that donor roller 42 provides a constant amount of developer with an appropriate toner concentration into the development zone. Magnetic roller 46 includes a non-magnetic tubular member 86 made preferably from aluminum and having the exterior circumferential surface thereof roughened. An elongated magnet 84 is positioned interiorly of and spaced from the tubular member. The magnet is mounted stationary and includes magnetized regions appropriate for magnetic pick up of the developer material from the developer chamber 76 and a nonmagnetized zone for developer material drop off. The tubular member rotates in the direction of arrow 92 to advance the developer material adhering thereto into a loading zone formed between magnetic roller 46 and donor roller 42. In the loading zone, developer material is preferentially magnetically attracted from the magnetic roller onto the donor roller. Augers 82 and 90 are mounted rotatably in chamber 76 to mix and transport developer material. The augers have blades extending spirally outwardly from a shaft. The blades are designed to advance the developer material in a direction substantially parallel to the longitudinal axis of the shaft.

The present invention can employ magnetic carrier of the conventional variety in that it comprises relatively "soft" magnetic material (e.g., magnetite, pure iron, ferrite or a form of $Fe_3O_4$) having a magnetic coercivity, Hc, of about 100 gauss or less. Such soft magnetic materials have been preferred heretofore because they inherently exhibit a low magnetic remittance, $B_R$, (e.g., less than about 20 EMU/gm but preferably less than 5 EMU/gm) in a high induced magnetic moment in the field applied by the brush core. Commonly applied examples of soft carrier material include copper zinc ferrite (CuZn ferrites) or nickel zinc (NiZn ferrites) core materials. Other materials which may be classified as soft magnetic carriers can include magnetite, pure iron, or ferrite (Fe3O4 for example). These materials will exhibit reduced magnetic saturation and lower coercivity values than that of the hard magnetic materials.

The present invention employs the addition of a physical carrier barrier to eliminate any opportunity for the carrier beads to interact with the photoreceptor surface. This approach provides additional advantages as a screen barrier approach is depicted in FIG. 3. A screen 400 is shown spaced above the developer bed in the development nip such that the carrier particles are not allowed to pass through the screen due to the physical size constraints, i.e. carrier particle diameter larger than the screen openings.

With a conductive screen another important attribute of the physical carrier barrier is that it provides a close spaced development reference electrode necessary for fine line development and uniform solids. As conductive magnetic brush development relies upon a bed of developer material to pass through the development nip limitations on the gap are induced. The presence of the developer bed serves to reduce the effective gap due to the dielectric value of the developer bed itself but with the addition of this screen as a reference electrode the developer bed dielectric properties become less critical. As well the reference electrode may be applied to avoid development of wrong sign toner. Both AC and DC biases have been applied demonstrating increased flow of toner through the screen to the receptor.

Principles of the present invention was tested in a simple bench experiment, a solenoid was applied to agitate a developer bed consisting of nominally 50 μm diameter permanent magnet carrier. The screen used in this case was a woven metal screen with 38 μm openings. The toner size was a nominal 10 μm diameter particle size which was sufficiently small enough to pass through the screen. Though toner did collect on the screen surface the addition of the AC and DC accelerating fields beneath the screen served to enhance the flow of toner though the screen. These AC and/or DC accelerating fields may be applied between the developer roll surface and screen surface to have a minimal effect on the development field.

The screen may be configured in any of a number of manners to include an etched flat screen, a woven screen or even an array of one or two dimensional wires mounted to provide the appropriate spacing between them. The screen may be mounted as a stationary member in the development nip in which case contamination of the screen or blocking of the apertures could become a reliability issue to be overcome. Solutions to this include intense carrier bead to screen interaction such that the screen may become continuously "scrubbed" with this while in addition providing enhanced toner release by the additional shearing and impact forces provided. An enhancement of this approach would employ a transducer to ultrasonically vibrate the carrier barrier to further enable cleaning. Carrier barrier material selection may include a ferrous material to further reduce flow through the permanent magnet carrier particles. Another consideration is a nonferrous material to reduce buildup which could prevent toner flow through.

Figure 5:
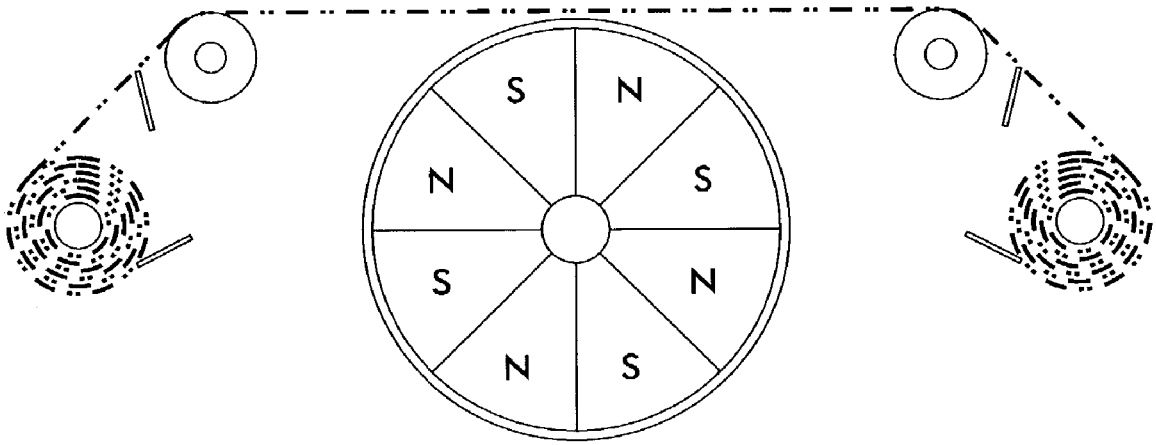
FIG. 5 is a screen clean device which could be incorporated with the present invention.

An alternative approach would employ a screen configuration which can be traversed through the development nip enabling cleaning of the screen. This may be accomplished with a window shade type (as indicated in FIG. 5) approach or with a rotating seamless screen configuration which could be cycled through the developer sump region. As with the stationary carrier barrier approach agitation of the member can serve to improve its effectiveness.

Use of a carrier barrier approach for conductive brush development non interactive development offers a number of unique advantages. For image on image architectures scavenging must be avoided which this approach accomplishes by eliminating any carrier bead interaction with the photoreceptor. A close spaced electrode is provided with the inclusion of a conductive carrier barrier provided a means to develop fine lines, uniform solids, and to minimize background development. Enhanced developer agitation can be applied to increase develop ability without the risk of increased scavenging or background development.

While the invention has been described with reference to the structures disclosed, it is not confined to the specific details set forth, but is intended to cover such modifications or changes as may come within the scope of the following claims:

What is claimed is:

1. In a development system including a developer transport adapted for depositing developer material on an imaging surface having an electrostatic latent image thereon, comprising:

a housing defining a chamber storing a supply of developer material comprising carrier and toner;

a donor member, mounted partially in said chamber and spaced from the imaging surface, for transporting developer on an outer surface thereof to a region opposed from the imaging surface, said donor member having a magnetic assembly having a plurality of poles, a sleeve, enclosing said magnetic assembly, rotating about said magnetic assembly;

a developer bed height of said developer material produce by the rotation of said magnetic assembly on said donor member to a predefine developer bed height within a development nip; and a grid, spaced and interposed between said donor member and the charge retentive surface, said grid having being dispose longitudinal with respect to the charge retentive surface and said donor member, said grid being spaced such that developer bed contacts said grid.

2. The development system of claim 1, wherein said grid comprises a plurality of apertures having a predefined size.

3. The development system of claim 2, wherein said carrier has a diameter that is substantially greater than said predefined size.

4. The development system of claim 1, wherein said grid comprises:

an endless web; and means for moving clean portion said web through the development zone.

5. The development system of claim 1, further comprising a vibrating device in communication with said grid.

6. In a development system including a developer transport adapted for depositing developer material on an imaging surface having an electrostatic latent image thereon, comprising:

a housing defining a chamber storing a supply of developer material comprising carrier and toner;

a donor member, mounted partially in said chamber and spaced from the imaging surface, for transporting developer on an outer surface thereof to a region opposed from the imaging surface, said donor member having a magnetic assembly having a plurality of poles, a sleeve, enclosing said magnetic assembly, rotating about said magnetic assembly;

a developer bed height of said developer material produce by the rotation of said magnetic assembly on said donor member to a predefine developer bed height within a development nip;

a grid, spaced and interposed between said donor member and the charge retentive surface, said grid having being dispose longitudinal with respect to the charge retentive surface and said donor member, said grid being spaced such that developer bed contacts said grid and means for maintaining said donor member at a first voltage potential and said grid at a second voltage potential, less than the first voltage potential.

7. The development system of claim 6, wherein the second voltage potential include an AC component and a DC component.

8. In a development system including a developer transport adapted for depositing developer material on an imaging surface having an electrostatic latent image thereon, comprising:

a housing defining a chamber storing a supply of developer material comprising carrier and toner;

a donor member, mounted partially in said chamber and spaced from the imaging surface, for transporting developer on an outer surface thereof to a region opposed from the imaging surface, said donor member having a magnetic assembly having a plurality of poles, a sleeve, enclosing said magnetic assembly, rotating about said magnetic assembly;

a developer bed height of said developer material produce by the rotation of said magnetic assembly on said donor member to a predefine developer bed height within a development nip;

a grid, spaced and interposed between said donor member and the charge retentive surface, said grid having being dispose longitudinal with respect to the charge retentive surface and said donor member, said grid being spaced such that developer bed contacts said grid and means for cleaning the web.

9. The development system of claim 1, wherein said predefine developer bed height contacts said grid.

* * * * *